US005355647A

United States Patent [19]

Johnson et al.

[11] Patent Number: 5,355,647

[45] Date of Patent: Oct. 18, 1994

[54] INSTALLED STRESS MASONRY SYSTEM

[76] Inventors: Stanley D. Johnson, 2310 W. Monterey Cir., Mesa, Ariz. 85202; Weldon R. Johnson, 3240 E. Highland Ave., Phoenix, Ariz. 85018

[21] Appl. No.: 969,958

[22] Filed: Nov. 2, 1992

[51] Int. Cl.[5] ..... E04B 5/48

[52] U.S. Cl. ..... 52/503; 52/405.3; 52/223.5; 52/223.7

[58] Field of Search ..... 52/405, 505, 309.12, 52/444, 593, 503, 223.7, 223.5, 606; 411/544, 155, 156

[56] References Cited

U.S. PATENT DOCUMENTS

| | | | |
|---|---|---|---|
| 3,618,279 | 11/1971 | Sease | 52/223.7 |
| 3,691,708 | 9/1972 | Firnkas | 52/228 |
| 4,249,354 | 2/1981 | Wynn | 52/438 |
| 4,688,362 | 8/1987 | Pedersen | 52/323.7 |
| 4,697,398 | 10/1987 | Granieri | 52 X/259 |
| 4,726,567 | 2/1988 | Greenberg | 52 X/223.7 |
| 4,748,782 | 6/1988 | Johnson | 52/405 |
| 4,769,964 | 9/1988 | Johnson . | |
| 4,790,704 | 12/1988 | Temple | 411 X/544 |
| 4,856,238 | 8/1989 | Kesting | 52 X/505 |
| 4,953,332 | 9/1990 | Galloway | 52/223.5 |
| 5,024,035 | 6/1991 | Hanson | 52 X/309.12 |
| 5,056,975 | 10/1991 | Ando | 411 X/544 |
| 5,062,244 | 11/1991 | Ducharme | 52 X/309.12 |
| 5,083,740 | 1/1992 | Sawyer | 411 X/544 |
| 5,112,178 | 5/1992 | Overhues | 411/544 |

*Primary Examiner*—Carl D. Friedman
*Assistant Examiner*—Beth A. Aubrey
*Attorney, Agent, or Firm*—LaValle D. Ptak

[57] ABSTRACT

A masonry wall system is constructed of concrete blocks, with interconnected insulation inserts. To provide for increased structural reinforcement, a steel butterfly-shaped plate is locked on an elongated rod passing through periodic courses of stacked blocks. The plate is locked perpendicular onto the rod, to rest on the top of the uppermost block in the course to which the stress or locking is applied. A recess is formed in the top of the block to accommodate the plate, which is bowed upwardly. A nut or threaded insert is used to press the plate downwardly; and when the plate lies flat, the desired amount of pressure or stress is applied to the blocks. Additional courses may be applied on top of the one to which the plate supplies the stress, with additional locking rods and plates being threaded onto the ends of previous rods to accomplish this purpose in additional courses of blocks forming the wall system.

13 Claims, 2 Drawing Sheets

INSTALLED STRESS MASONRY SYSTEM

BACKGROUND

Free-standing masonry walls typically are constructed of concrete blocks or the like, in running courses, using mortar between the courses and between the ends of each of the blocks. Concrete blocks typically have one or more voids extending through them in the vertical direction to create vertical voids through the walls. Reinforcing bars are placed in these voids for inclusion within a continuous vertical grout column, in accordance with building code standards. Such grout columns typically are placed approximately four feet apart along the length of the wall. Normally, the voids in blocks, which are not involved in the formation of a vertical grout column, are left empty. To provide improved thermal insulation qualities for such masonry walls, the empty voids in masonry block walls may be filled with insulation to reduce the thermal energy transfer between the inner and outside walls of the blocks, and thus of the free-standing wall, which is formed from the blocks.

U.S. Pat. No. 4,769,964 to Johnson is directed to a self-aligned and self-leveled, insulated drystack block wall construction. In the construction blocks disclosed in this patent, insertable cores of insulating material are placed in the voids or openings in the blocks to improve the interlocking of the blocks in forming a wall, and to reduce thermal energy transfer between the inner and outer sides or walls of the blocks used to form the wall. In the Johnson patent, the inserts also assist in self-alignment and self-leveling of a running course of block used to construct the wall. To meet building codes requiring a continuous vertical grout column at periodic intervals along the running length of the wall, various ones of the insulation cores are eliminated from the blocks to form a continuous vertical void in the standing wall. Reinforcing bar then is inserted into the voids established by the removal of the cores, and grout is used to fill the voids to establish the required grout cell. These grout cells are formed in a conventional manner, after erection of the wall, to produce the required structural reinforcement.

In the construction of masonry block or concrete block walls, of the type disclosed in the above mentioned Johnson patent, no pre-stressing or post-stressing of the wall thus formed is employed. The structural rigidity is provided by the reinforcing bar and grout columns formed in the walls subsequent to their erection. The regions where the grout columns are formed have a greater thermal conductivity (and, therefore, provide less insulating qualities) than the regions between the grout columns, where either insulating inserts are provided, or air-filled voids exist.

It is desirable to provide a masonry wall of concrete wall construction which incorporates the advantages of the insulating inserts of the Johnson patent, and which provides the reinforcement typically produced by grout columns, by continuously utilizing installed stress in the wall at periodic intervals along the wall.

SUMMARY OF THE INVENTION

It is an object of this invention to provide an improved masonry wall system.

It is another object of this invention to provide an improved insulated masonry wall system.

It is an additional object of this invention to provide an improved structural reinforcement for a masonry wall system.

It is a further object of this invention to provide an improved masonry wall system employing installed stress structural reinforcement at periodic intervals along the running length of the wall.

In accordance with a preferred embodiment of this invention, an installed stress masonry wall system is made of a plurality of masonry wall blocks, each having an upper surface and a lower surface. Each of the blocks has a void extending through it, and through the upper and lower surface. At the intervals requiring structural reinforcement, an elongated vertical rod, which is anchored in the surface on which the wall is erected, extends vertically through the voids of multiple courses of the blocks in the wall system. A clamping plate then is placed over the upper surface of the upper course, through which the elongated rod extends; and tension is applied between the rod and the clamping plate to apply pressure to the upper surface of the block, resulting in a compression force applied downwardly through the wall system at each place where a reinforcement rod and a clamping plate are utilized.

DETAILED DESCRIPTION

Figure 4:
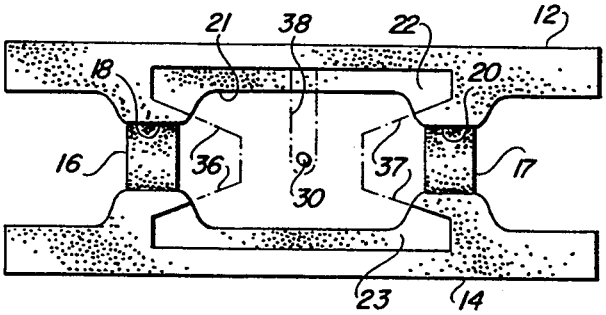
FIG. 4 is a top view of a masonry block used in conjunction with the apparatus of FIG. 1.
Figure 5:
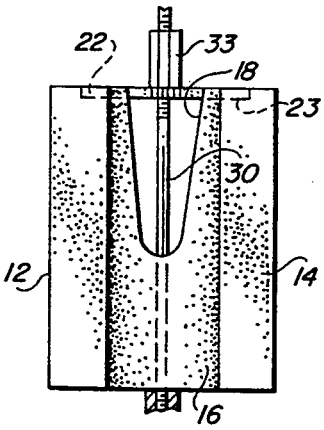
FIG. 5 is an end view of the block of FIG. 4, illustrating the apparatus of FIG. 1 in use.
Figure 6:
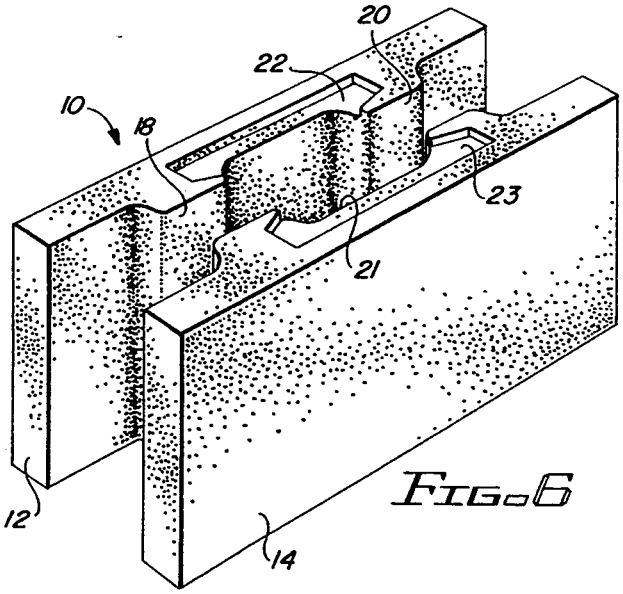
FIG. 6 is a perspective view of the block shown in FIG. 4.
Figure 7:
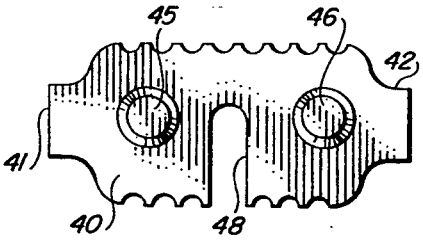
FIG. 7 is the top view of an insert used with the block of FIGS. 4, 5 and 6.
Figure 8:
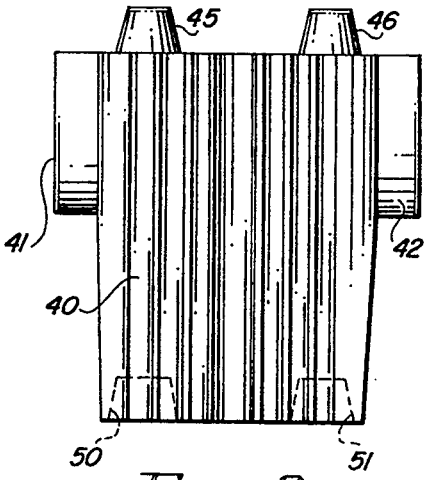
FIG. 8 is a side view of the insert shown in FIG. 7.

Reference now should be made to the drawings., in which the same reference numbers are used throughout the different figures to designate the same or similar components. Initially, reference should be made to FIGS. 4, 5 and 6, which illustrate the configuration of an improved masonry block of concrete block 10, made in accordance with a preferred embodiment of the invention. The block 10 has first and second outside walls 12 and 14, respectively. These walls, when this block is incorporated with other blocks in an installed stress masonry wall system, constitute the vertical inner and outer wall surfaces of the masonry wall system constructed. A typical dimension of the block shown in FIGS. 4, 5 and 6 is six inches wide by eight inches high, and sixteen inches long. Obviously, other dimensions clearly may be employed, provided that the relative dimensions and locations of the various parts of the blocks shown in these figures is maintained.

The outer walls 12 and 14 are approximately $1\frac{1}{4}''$ thick, eight inches high and sixteen inches long. These two walls are connected by two cross walls of webs 16 and 17, shown most clearly FIGS. 4 and 5. This causes the block 10 to appear as two interconnected "H" shapes, linearly aligned with one another when the block 10 is viewed from the top (FIG. 4). The upper surfaces of the webs 16 and 17 are formed as a "U" shape, extending downwardly from the top of the block 10 approximately four inches. This shape is seen most clearly in the end view of FIG. 5, which shows the web 16. The web 17 is identical in configuration, and is aligned with the web 16.

Each of the U-shaped of oval openings at the upper ends of the webs 16 and 17 constitutes a shelf for accepting and aligning insulation core inserts 40, subsequently placed in the blocks, prior to or during the construction of a masonry wall system using the blocks 10. Also, when the depressions OF openings in the top of the webs 16 and 17 are formed in a U-shaped or oval configuration, the molding of the blocks is improved by allowing the free flow of cementitious or other material in the molding process. This shape also reduces the wear on the mold inserts when they are withdrawn from the blocks to lengthen the life of such mold inserts.

As seen most clearly in FIGS. 4 and 6, the inner surfaces of the outer face walls 12 and 14 are thickened in the areas 18 and 20, where they are connected to the cross webs 16 and 17. This creates reinforcement columns in the wall system constructed using the blocks, and provides for increased unit compressive strength in the use of the system, as described subsequently.

Figure 11:
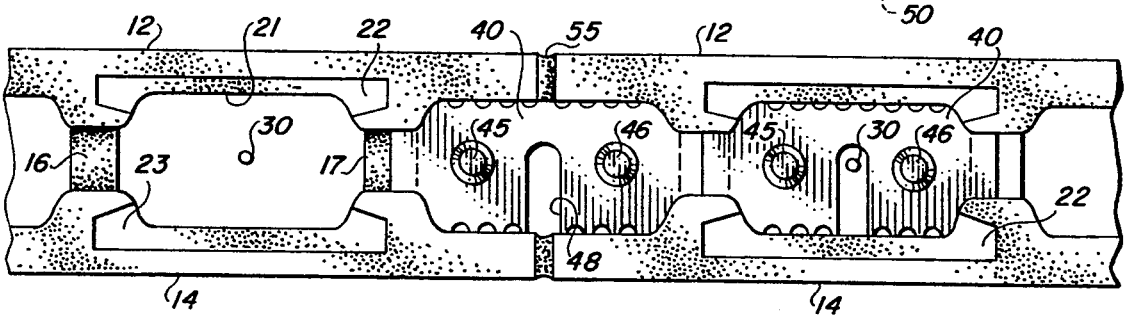
FIG. 11 is a top view of a wall section of the type shown in FIGS. 2 and 3.

When blocks 10, of the type shown in FIGS. 4, 5 and 6, are placed end-to-end, the void formed between the ends of adjacent blocks (allowing for standard thickness of mortar 55 if drystack construction is not used), is identical in shape and configuration to the void 21 formed through the center of each of the blocks. This permits the construction, in a running bond configuration, as illustrated in FIG. 11 when the insulation core inserts are placed in either of these locations.

Depressions 22 and 23 are formed on opposite sides of the central void 21 in the center of each of the blocks 10, as is seen most clearly in FIGS. 4 and 6. These depressions are approximately ⅛" deep; and they are centered along the longitudinal axis of the wall formed by the outer faces 12 and 14.

To provide improved thermal insulation qualities for a wall constructed of the blocks 10, tapered insulation cores 40 (FIGS. 7 to 10) are inserted into the voids 21 formed in the center of each of the blocks between the cross-connecting webs 16 and 17. The cores 40 also are inserted in the voids formed between adjacent blocks when they are placed end-to-end. The voids between two adjacent blocks are identical in size and shape to the voids 21; so that only one size of insulation core 40 is required. The cores 40 are formed with ribs or fluting extending vertically, along the sides of the inserts the full length. This provides passage for moisture migration vertically in the assembled wall, when the units are placed in a "running bond" allowing each insulation core insert 40 to align with all of the other insulation cores in the wall vertically.

The cores 40 typically are manufactured of a low density foam insulation, such as polystyrene or the like. Then they are used to fill the voids 21, and the voids between adjacent blocks, as described above, these insulation cores 40 enhance the insulation qualities of the blocks 10 used in the wall to significantly decrease thermal conduction from one of the wall faces 12 or 14 to the other.

Each of the insulating core inserts 40 has a pair of downwardly extending U-shaped projections or "ears" 41 and 42 on opposite edges. These projections are formed to fit within the U-shaped openings in the cross webs 16 and 17, and extend outwardly to a distance which is approximately one-half the width of the webs 16 and 17, measured longitudinally of the blocks 10. This is illustrated most clearly in FIG. 11.

Each of the insulating core inserts 40 also has a pair of frustoconical projections 45 and 46 located in its top, midway between the center and the outer edge of the corresponding ears 41 and 42. Similarly shaped recesses 50 and 51 are located in the bottoms of each of the inserts 40. The recesses 50 and 51 receive the projections 45 and 46 of an insulating core insert 40 located in a lower block 10. The projections 45 and 46 and recesses 50 and 51 assist in aligning the blocks 10, in which the insulating core inserts 40 are placed, to facilitate the construction of the wall in which they are used. Thus, the projections 45 and 46 and recesses 50 and 51 permit a positive interlock between the various insulating core inserts when they are placed atop one another as the blocks 10 are assembled in a "running bond" pattern to create a masonry wall.

Figure 10:
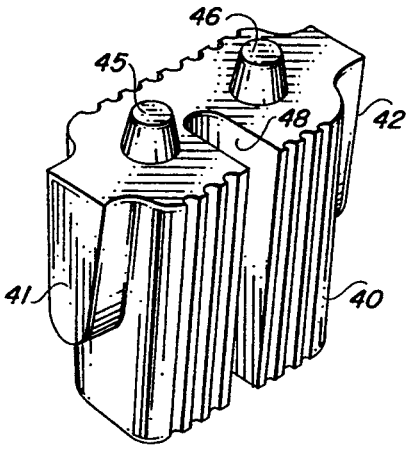
FIG. 10 is a perspective view of the insert shown in FIGS. 7, 8 and 9.
Figure 9:
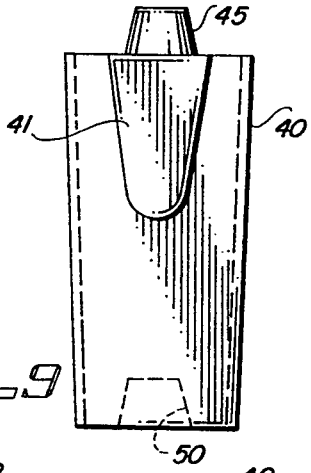
FIG. 9 is an end view of the insert shown in FIG. 7.

Each of the inserts 40 also has a U-shaped slot 48 extending from one edge slightly past the center of the core insert 40, and extending vertically through it, as shown most clearly in FIGS. 10 and 11. These slots 48 function as an avenue for the placement of reinforcement rods for structural reinforcement periodically occurring within a wall, and also function for a guide for electrical wiring when they are not used in a reinforcement rod configuration.

Many local building codes require vertical structural reinforcement to be placed in a masonry or concrete block wall at regularly spaced intervals along the length of the wall. Typically, these intervals are approximately every four feet. In a conventional concrete block wall, these vertical reinforcements are formed by what is known as "grout cells" and are constructed by placing reinforcing bar within the grout cell, in voids which are formed through all of the blocks in this position, such that the voids align to form a continuous vertical void in the finished standing wall. After the reinforcing ban is inserted into such voids, grout is poured into the voids to establish the required reinforced grout cell. Such a construction may be employed with the blocks shown in FIGS. 4 through 6. It is obvious that where such a grout cell is formed, however, no insulation core inserts 40 may be used; so that the thermal insulating characteristics of the wall are impaired at the location of each of such standard grout cells.

Figure 1:
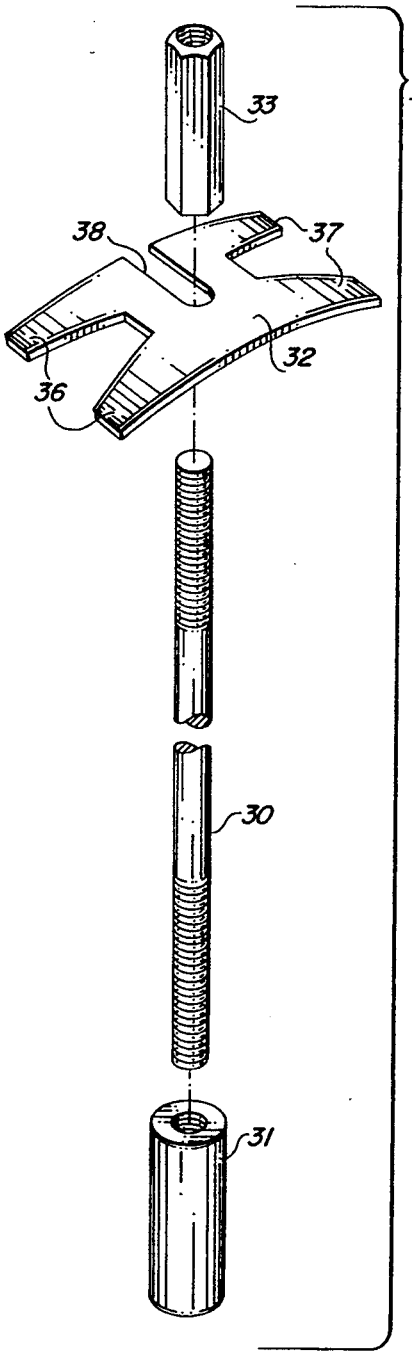
FIG. 1 is an exploded view of a portion of a preferred embodiment of the invention.
Figure 2:
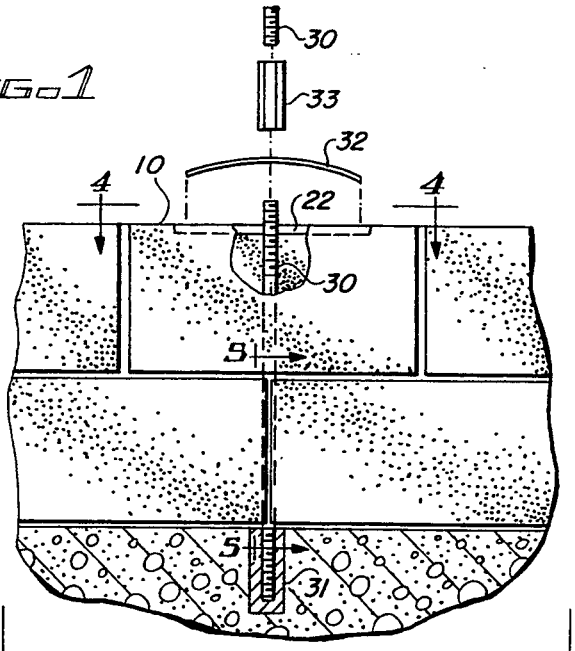
FIGS. 2 and 3 illustrate the manner of use of the apparatus shown in FIG. 1.
Figure 3:
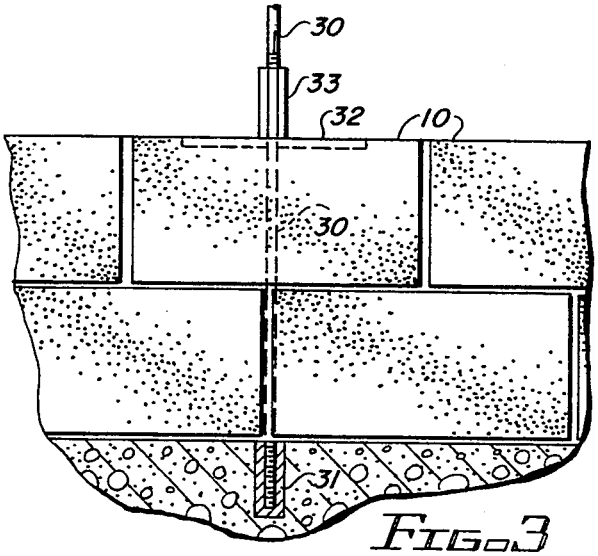

To maintain the high insulating properties of a wall constructed as described above, and also to provide the required vertical reinforcement without using grout cells, the structural reinforcement apparatus illustrated in FIG. 1 is used. The manner in which the apparatus of FIG. 1 is used is illustrated in FIGS. 2 and 3. At periodic courses of blocks 10 stacked in running bond pattern (two such courses are shown in FIGS. 2 and 3), steel "butterfly"-shaped clamp plates 32 are locked perpendicular onto reinforcing rods 30 to cause the plates 32 to rest in the recesses 22 and 23 on the top surface of the top block 10 in the course which is undergoing reinforcement.

In the construction of the wall, whether using mortar or as a drystack wall, a threaded base anchor 31 is placed in the underlying foundation. A reinforcing rod or bar 30, which is threaded at its lower end, is threaded into the anchor 31 to anchor the rod 30 in place. The rod 30 extends upwardly, through however many courses of block 10 are to be laid prior to installing stress through the butterfly clamp 32, in the manner to be described. As is most evident from FIG. 11, the insulating inserts 40 may be placed in the voids 21 in the center of the blocks 10, or between adjacent courses, with the rods 30 in place, by sliding them onto the rods 30 in the position shown in FIG. 11, and then pressing them downwardly into the void in the block. In this manner, even the regions in which the reinforcing rods 30 are located are fully insulated to the same extent as regions of blocks 10 which do not have any reinforcing rods 30 in them.

Once the desired number of courses have been laid, a butterfly plate 32 is moved into position through a slot 38 in it to center it with a pair of projections 36 on one end, and a pair of projections 37 on the other end, resting in the ends of the depressions 22 and 23 formed in the top of the block 10. As illustrated in FIGS. 1 and 2, the butterfly clamp plates 32 have a slight upward bow in them. The plates are made of spring steel; and the amount of bow is selected in accordance with the overall thickness and strength of the plate to provide a pre-established amount of downward pressure or stress on the top of the block 10 when a threaded sleeve 33 is tightened over the threaded end of the reinforcing rod 30 to press the plate 32 downwardly.

The bowed shape of the butterfly clamp plate 32 functions as an indicator to indicate when the proper installed stress pressure is applied to the assembled wall. The pressure desired is achieved when the plate 32 bends to a flattened position against the top of the depression 22 and 23. At this point, tightening of the sleeve 33 is terminated, and the pre-established compression force desired for the finished assembly is achieved.

For additional courses, the sleeve 33 is threaded throughout its length; so that a second reinforcing rod 30 may be threaded into the upper end of the sleeve 33, as illustrated in FIGS. 2, 3 and 5. Then this is done, additional courses of block 10 may be laid; and after the desired number of courses are in place, an additional spring steel butterfly plate 32 and threaded insert 33, or a nut, may be used to clamp down the next series of courses under the desired installed stress. This is done until the top of the wall is reached, at which time a final nut is threaded onto the last of the reinforcing rods 30 to clamp the final butterfly plate 32 in place on the top of the upper course of block.

The depth of the recesses 20 and 23 is selected to be equal to or greater than the thickness of the butterfly plates 32; so that when the plates 32 are flattened into place onto the top of a block 10, they are fully contained within the recesses 22 and 23. As a consequence, the locking plates 32 do not interfere in any way with the subsequent courses of the wall, which are built up around these plates. It also should be noted that the width of the slot 48 in the insulating inserts 40 is selected to be sufficiently large to fit around the threaded sleeve 33 in a fully assembled wall.

The utilization of the reinforcing rods 33, butterfly plates 32 and threaded inserts 33 provides a an installed stress concrete block wall in which the reinforcing rods 30 and the accompanying clamping plates and threaded inserts or nuts may be used to replace the conventional vertical grout columns, which have been used in the past. By placing the different courses of the wall under stress, in the manner indicated above, a wall which is capable of withstanding substantial lateral forces is created.

The system which has been described may be employed in a drystack construction process, or a construction process using mortar between the blocks. The installed stress technique and the insulation provided by the inserts 40 is the same for either type of construction.

The foregoing description of the preferred embodiment of the invention, taken in conjunction with the drawings, should be considered as illustrative and not as limiting. Various changes and modifications will occur to those skilled in the art, without departing from the true scope of the invention as defined in the appended claims.

We claim:

1. A standing masonry wall system including in combination:

a plurality of masonry blocks arranged in courses to form said wall system, each of said blocks having an upper surface and a lower surface, with at least predetermined ones of said blocks having a recess of a predetermined shape in the upper surface thereof, and each of said blocks having a first void therethrough extending through the upper and lower surfaces;

structured reinforcement means including a plurality of elongated rods anchored to a foundation, each rod having a predetermined length sufficient to pass through a predetermined number of courses of said masonry blocks in said wall system to extend above the upper surface of said blocks in the upper one of said courses, with the blocks above the upper surface of which said rods extend being said predetermined ones of said blocks, said elongated rods being threaded at the upper end thereof, and said predetermined number of courses of masonry blocks being less than the total number of courses of said masonry blocks in said wall system;

clamping plate means having a bowed configuration fitting over said rods and having a shape corresponding to said predetermined shape of the recesses in the upper surfaces of said predetermined ones of said blocks, said clamping plate means overlying and fitting into the recesses in the upper surfaces of said predetermined ones of said blocks through which said elongated rods extend said clamping plate means providing an indication when a predetermined pressure is applied thereby to the upper surfaces of said predetermined ones of said blocks when said means for applying stress between said rod means and said clamping plate means flattens said clamping plate means into the corresponding recesses in the Upper surfaces of said predetermined ones of said blocks; and elongated threaded sleeves for engaging the threaded ends of each of said rods to apply stress between said rods and said clamping plate means to apply pressure to the upper surfaces of said predetermined ones of said blocks in said wall system, each of said threaded sleeves being adapted for receiving the lower end of another of said elongated rods for extending vertically upwardly through an additional predetermined number of courses of said masonry blocks in said wall system.

2. The combination according to claim 1 wherein each of said clamping plate means has an aperture therein to permit passage of a corresponding elongated rod therethrough.

3. The combination according to claim 1 wherein each of said plurality of masonry blocks are configured with openings on the ends thereof on opposite sides of the portion with said first void therethrough, such that when said masonry blocks are placed end-to-end in a course of said wall system, each pair of adjacent blocks forms a second void having the same configuration as said first void through each of said blocks.

4. The combination according to claim 3 further including insulating cell core means for insertion into said first and second voids extending through each of said plurality of masonry blocks.

5. The combination according to claim 4 wherein said insulating cell core means have vertical apertures extending through the center thereof for receiving said elongated rods.

6. The combination according to claim 5 wherein said insulating cell core means each have mating engagement means thereon for engaging others of said insulating cell core means in said masonry blocks located in courses above and below each of said blocks for interlocking said plurality of said masonry blocks together in said masonry wall system.

7. The combination according to claim 6 wherein each of said plurality of masonry blocks is constructed with first and second parallel spaced-apart outer face walls interconnected by first and second cross webs spaced equidistant along the longitudinal axis of each of said masonry blocks.

8. The combination according to claim 1 wherein the upper surface of each of said predetermined ones of said masonry blocks has a recess therein for receiving said clamping plate means.

9. The combination according to claim 1 wherein each of said plurality of masonry blocks is constructed with first and second parallel spaced-apart outer face walls interconnected by first and second cross webs spaced equidistant along the longitudinal axis of each of said masonry blocks.

10. A standing masonry wall system including in combination:

a plurality of masonry blocks arranged in courses to form said wall system, each of said blocks having an upper surface and a lower surface, with at least predetermined ones of said blocks having a recess of a predetermined shape in the upper surface thereof, each of said blocks having a first void therethrough extending through the upper and lower surfaces, and each of said masonry blocks being configured with openings on the ends thereof on opposite sides of the portion with said first void therethrough, such that when said masonry blocks are placed end-to-end in a course of said wall system, each pair of adjacent blocks forms a second void having the same configuration as said first void through each of said blocks;

structured reinforcement means including a plurality of elongated rods anchored to a foundation, each rod having a predetermined length sufficient to pass through a predetermined number of courses of said masonry blocks in said wall system to extend above the upper surface of said blocks in the upper one of said courses, with the blocks above the upper surface of which said rods extend being said predetermined ones of said blocks, said elongated rods being threaded at the upper end thereof, and said predetermined number of courses of masonry blocks being less than the total number of courses of said masonry blocks in said wall system;

clamping plate means fitting over said rods and having a shape corresponding to said predetermined shape of the recesses in the upper surfaces of said predetermined ones of said blocks, said clamping plate means overlying and fitting into the recesses in the upper surfaces of said predetermined ones of said blocks through which said elongated rods extend; and elongated threaded sleeves for engaging the threaded ends of each of said rods to apply stress between said rods and said clamping plate means to apply pressure to the upper surfaces of said predetermined ones of said blocks in said wall system, each of said threaded sleeves being adapted for receiving the lower end of another of said elongated rods for extending vertically upwardly through an additional predetermined number of courses of said masonry blocks in said wall system.

11. The combination according to claim 10 wherein each of said plurality of masonry blocks is constructed with first and second parallel spaced-apart outer face walls interconnected by first and second cross webs spaced equidistant along the longitudinal axis of each of said masonry blocks.

12. The combination according to claim 11 further including insulating cell core means for insertion into said first and second voids extending through each of said plurality of masonry blocks.

13. The combination according to claim 12 wherein said insulating cell core means have vertical apertures extending through the center thereof for receiving said elongated rod means.

* * * * *